US005560294A

United States Patent [19]

Anders et al.

[11] Patent Number: 5,560,294

[45] Date of Patent: Oct. 1, 1996

[54] DEVICE FOR INKING A SCREEN ROLLER

[75] Inventors: Horst Anders, Thiergarten; Ulrich Denk, Thossfell, both of Germany

[73] Assignee: MAN Roland Druckmaschinen AG, Offenbach am Main, Germany

[21] Appl. No.: 373,977

[22] Filed: Jan. 18, 1995

[30] Foreign Application Priority Data

Jan. 18, 1994 [DE] Germany ..... 44 01 365.5

[51] Int. Cl.[6] ..... B41F 31/03; B41F 31/30

[52] U.S. Cl. ..... 101/366; 101/351; 101/DIG. 34

[58] Field of Search ..... 101/350, 351, 101/363, 364, 365, 366, 367, 157, 169, 207–210, DIG. 34; 118/410, 413

[56] References Cited

U.S. PATENT DOCUMENTS

| | | | |
|---|---|---|---|
| 2,399,688 | 5/1946 | Metzner et al. | 101/364 |
| 3,052,183 | 9/1962 | Zernov et al. | 101/364 |
| 3,631,800 | 1/1972 | Mignone et al. | 101/366 |
| 4,058,058 | 11/1977 | Hantscho | 101/365 |
| 4,548,840 | 10/1985 | States et al. | 118/413 |
| 4,590,855 | 5/1986 | Schommer et al. | 101/350 |
| 4,934,310 | 6/1990 | Wöhrle et al. | 118/413 |
| 4,998,474 | 3/1991 | Haver | 101/366 |
| 5,003,876 | 4/1991 | Harrison et al. | 101/350 |
| 5,031,529 | 7/1991 | Greenwood | 101/366 |
| 5,406,887 | 4/1995 | Hertel et al. | 101/366 |

FOREIGN PATENT DOCUMENTS

| | | | |
|---|---|---|---|
| 315091 | 5/1989 | European Pat. Off. . | |
| 0392406 | 10/1990 | European Pat. Off. . | |
| 2264119 | 7/1974 | Germany . | |
| 3025291 | 1/1982 | Germany . | |
| 3443510 | 6/1986 | Germany | 101/364 |
| 3843017 | 5/1990 | Germany . | |
| 3911839 | 10/1990 | Germany . | |
| 1659227 | 6/1991 | U.S.S.R. . | |
| 9310976 | 6/1993 | WIPO . | |

*Primary Examiner*—Stephen Funk
*Attorney, Agent, or Firm*—Cohen, Pontani, Lieberman, Pavane

[57] ABSTRACT

A device for inking a screen roller of a rotary printing machine, with an ink chamber, arranged along side of the screen roller, which has an opening pointing toward the screen roller and which is closed on the front side by side walls and which has at least one ink inlet as well as a chamber body with a circular interior. In order to allow the screen roller to be inked in a manner correct for printing using simple technical devices, the ink inlet into the inking chamber is to allow the creation of an ink roll moved by the screen roller during operation in a rotating fashion.

24 Claims, 4 Drawing Sheets

DEVICE FOR INKING A SCREEN ROLLER

BACKGROUND OF THE INVENTION

1. Field of the Invention

The invention relates to a device for inking a screen roller of a rotary printing machine which device includes an ink chamber arranged alongside of the screen roller, which chamber has an opening pointed toward the screen roller and is closed on the end face by sidewalls. The chamber has at least one ink inlet and is defined by a circular interior of a chamber body.

2. Description of the Prior Art

A chamber blade of an anilox offset unit is known from EP 0 315 091 B1. This reference teaches an ink chamber that is bordered by a blade roller, a chamber body with a circular interior, two blades, namely, a working blade with a negative positioning angle and a closing blade with a positive positioning angle, and two side walls. Additionally, a rotatable cylindrical body is provided so that its distance to the screen roller can be changed.

In the case of this chamber blade, ink impoverishment occurs in the ink chamber in the area between the gap of the rotatable cylindrical body and the working blade, which area is important for the inking of the screen roller. The contraction of the flow cross-section in this gap encourages both ink-whirling and an increase in ink temperature which impedes the creation of a laminar ink flow in the ink chamber.

In addition, the arrangement results in a sufficiently large body, relative to a deflection due to the great ink pressure in the gap, which requires a relatively large ink chamber. This, together with the ink density and a positioning of the side walls to allow a radial movement requires a correspondingly high technical expenditure.

SUMMARY OF THE INVENTION

The object of the present invention is to provide a device for inking a screen roller which avoids the disadvantages of the prior art and makes it possible, using simple technical means, to ink the screen roller in a manner correct for printing.

Pursuant to this object, and others which will become apparent hereafter, one aspect of the present invention resides in a device for inking a screen roller of a rotary printing machine, which device has an ink chamber with an ink inlet arranged so as to create an ink roll that is moved in a rotating manner by rotation of the screen roller.

Through the absence of cross-sectional contractions in the ink chamber as well as the avoidance of projections and recesses on the circumference thereof, together with the special ink supply in the central area of the ink chamber having the lowest flow speed or tangentially or frontally to the ink roll in its rotational direction and, as applicable, axial ink extraction, the invention permits the formation of a laminar flow which reaches immediately up to the working blade in the form of a roll consisting of ink, with maximum ink density in the area in front of the working blade that is especially important for the inking of the screen roller.

Adequate filling of the ink chamber during ongoing replenishment of the ink consumed in the printing process is already favored by a low ink overpressure in the ink chamber, because with increasing printing speed, particularly the flow speed and the ink concentration on the circumference of the more quickly rotating ink roll, the inking of the screen roller increases.

In another embodiment of the invention, the ink inlet is designed to feed the ink into the ink chamber in a generally axial manner, preferably centrally to the ink roll.

The ink inlet can also be designed to feed the ink into the ink chamber generally tangentially to the ink roll in the rotational direction of the ink roll. It is also possible to design the ink inlet to feed the ink into the ink chamber frontally to the ink roll.

In yet a furtiler embodiment of the invention, an ink outlet is provided to guide the ink from the ink chamber frontally, preferably centrally to the ink roll, from a side opposite the frontal ink supply to the chamber.

The ink chamber can be bordered in tile rotational direction of the screen roller, alongside the screen roller, by a working blade with a negative positioning angle. The ink chamber can further be bordered opposite to the rotational direction of the screen roller by a closing blade with a positive positioning angle.

In still another embodiment, the ink chamber is longitudinally bordered opposite to the rotational direction of the screen roller by the interior of the chamber body so as to form a gap with the screen roller. A closing blade can be connected to the chamber body before the gap opposite to the rotational direction of the screen roller, and preferably with a negative positioning angle. The closing blade can be located in a slot in the chamber body or can be connected to a longitudinal side of the chamber body.

The feeding of ink to the ink chamber is regulated in reliance upon the ink overpressure in the ink chamber, while the interior walls of the chamber body which define the ink chamber can be smooth or ink repellant.

In yet a further embodiment of the invention the working blade is attached to the chamber body in an adjustable manner by a working blade support arranged to be movable tangential to the circular interior of the chamber body.

A further embodiment provides the closing blade attached to the chamber body in an adjustable manner by a separate closing blade support arranged to be movable tangentially to the circular interior of the chamber body.

In still yet another embodiment of tile invention the chamber body is provided so that it can be set upon and moved away from tile screen roller. With the chamber body being positionable onto the screen roller, the working blade support or the closing blade support are also settable relative thereto. Furthermore, the working blade support and the closing blade support can be fixed in a working position of the blades.

In still another embodiment of tile invention, tile chamber body is attached to a blade carrier which is positionable via a stop in a movable and multi-level manner, at low pressure, on the screen roller. An adjusting spindle passes through the blade carrier and acts to grip the working blade support and the closing blade support. At least one clamping lever is swingably arranged on the blade carrier to permit changing of tile working blade. A pressure-operated working cylinder is operatively connected to the clamping lever whereby the working blade support is fixed.

In a furtiler embodiment, back-gripping arresting bodies are arranged in form-fitting fashion in recesses of tile chamber body. At least one of the arresting bodies is detachably mounted in its respective recess. The detachable arresting body is a lever pivotably mounted to the blade carrier. A working cylinder is connected to the lever and also pivotably connected to the blade carrier.

In an additional embodiment the blade carrier is pivotably mounted in holders rigidly connected to the frame of the device. Each holder is respectively equipped with an adjustable spindle that works together with the stop mounted on the blade carrier, as well as with a pivot bearing of a working cylinder that is linked to the blade carrier.

In another embodiment, the sidewalls are arranged to laterally cover the ink chamber and radially seal off the ink relative to the screen roller. The ink inlet and ink outlet can be provided as axial bores in the respective sidewalls.

In still a further embodiment of the invention the ink inlet is made up of at least one bore in the chamber body that opens tangentially to the interior of the chamber body. The ink inlet can also incorporate a longitudinal slot in the chamber body that opens tangentially to the interior.

Still another embodiment of the invention provides that the ink inlet is a pocket-shaped recess in one of the sidewalls, which recess is open to the ink chamber and is connected to a cross bore.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
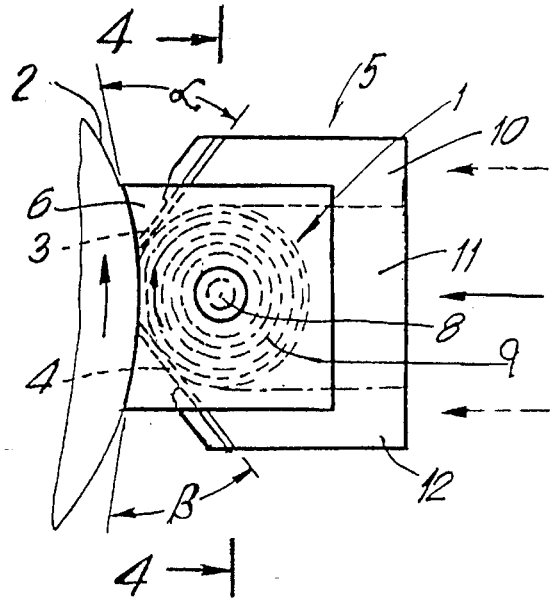
FIG. 1 is a schematic cross-section of a chamber blade pursuant to the present invention with an axial supply and extraction of ink.
Figure 4:
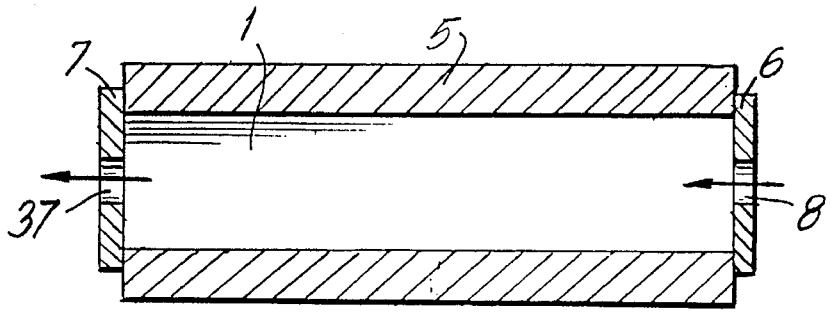
FIG. 4 is a section 4—4 of FIG. 1.

The schematic depiction of the inventive chamber blade of FIG. 1 shows an ink chamber 1 which is bordered by a screen roller 2 that functions as an inking roller or a form cylinder. A working blade 3 is provided with a negative positioning angle $\alpha$ relative to the rotational direction (indicated by an arrow) of the screen roller 2 and a closing blade 4 is provided with a positive positioning angle $\beta$. The ink chamber 1 is bounded by a chamber body 5 having a circular interior, and two side walls 6, 7 (FIG. 4).

An ink inlet 8 is located in the side wall 6, in the central area of the ink chamber 1, whereby a supply of ink is regulated so that a low overpressure is established in the ink chamber 1.

Due to adhesion, the ink in the ink chamber 1 is set into rotation as a laminar flow by the screen roller 2, so that a rotating roll consisting of ink—designated the ink roll 9—is formed. The ink roll 9 brings about an intensive inking of the screen roller 2 in front of the working blade 3, whereby this effect automatically increases as the speed of the screen roller 2 increases.

Compared to the basic embodiment shown in FIG. 1, which provides joint adjustment of both blades across the undivided chamber body 5, it is advantageous, in respect to the settability of the chamber blade, to ensure separate mobility of the blades. To this end, in a first variant (shown by a broken line), the chamber body 5 is divided into two parts, namely a working blade support 10 arranged so as to be tangentially shiftable relative to the circular interior and a basic body 11 which carries the closing blade 4. In another variant (shown by a dashed line), the chamber body 5 is divided into three parts, namely, the two parts of the first variant and a separate closing blade support 12 similarly constructed to the working blade support 10.

Figure 2:
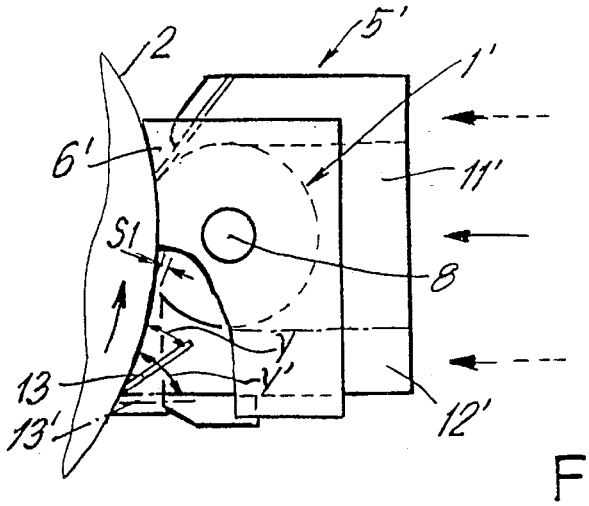
FIG. 2 is a view similar to FIG. 1 with a modification in the area of the closing blade.

The embodiment shown in FIG. 2 is modified relative to the embodiment of FIG. 1 in that the beginning of the inking zone is determined by a gap S1 formed between an elongated interior portion of the chamber body 5 and the screen roller 2. Before this gap S1 opposite to the rotational direction of the screen roller 2, a closing blade 13 is arranged in a slot of the basic body $\mathbf{11}^{I}$ or the separate closing blade support $\mathbf{12}^{I}$, with a negative positioning angle $\gamma$. The separate closing blade support $\mathbf{12}^{I}$, as shown by the dashed line, upon appropriate correction of the positioning angle $\gamma^{I}$ provides the possibility of attachment of the closing blade 13' to the outer side of the basic body.

Figure 3:
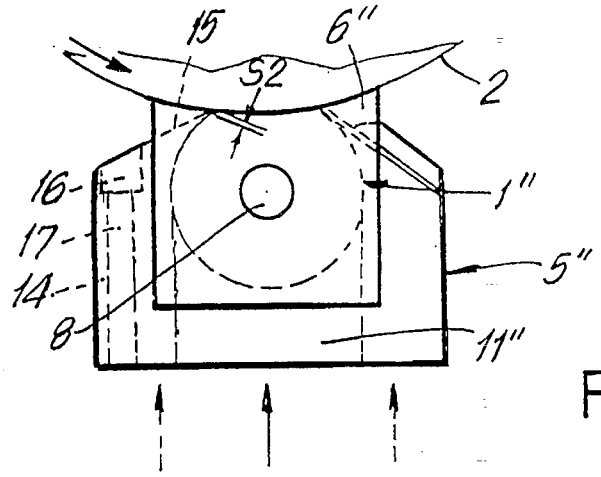
FIG. 3 is a view similar to FIG. 2 without the closing blade.

In contrast to FIG. 2, FIG. 3 shows, in a chamber blade arranged below the screen roller 2, a minimally-designed gap S2, which is bordered externally by an ink run-off surface 15 which is inclined toward the longitudinal side of the chamber body $\mathbf{5}^{II}$ or of a separate side part 14 which permits a separate adjustment of the gap S2. The ink run-off surface 15 is equipped with an ink collection groove 16 with an ink return passage 17.

In FIG. 3, depending on the viscosity of the ink, only a low ink delivery occurs at the gap S2, so that a closing blade can be completely dispensed with in connection with the described design.

Figure 6:
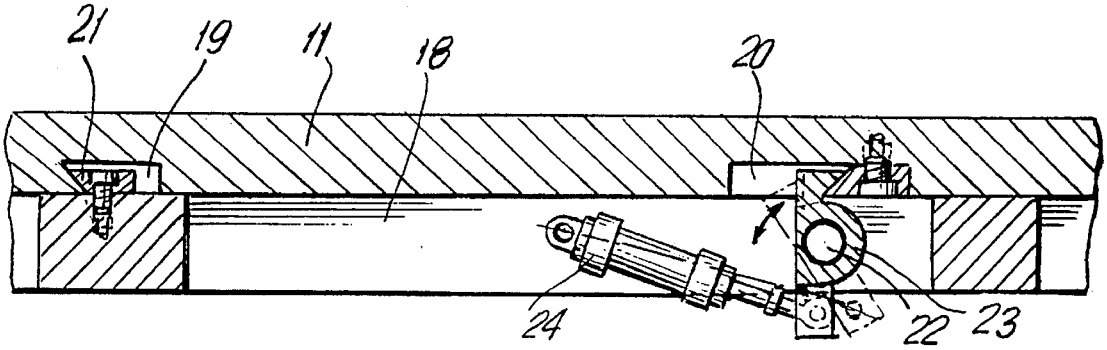
FIG. 6 section 6—6 of FIG. 5.
Figure 5:
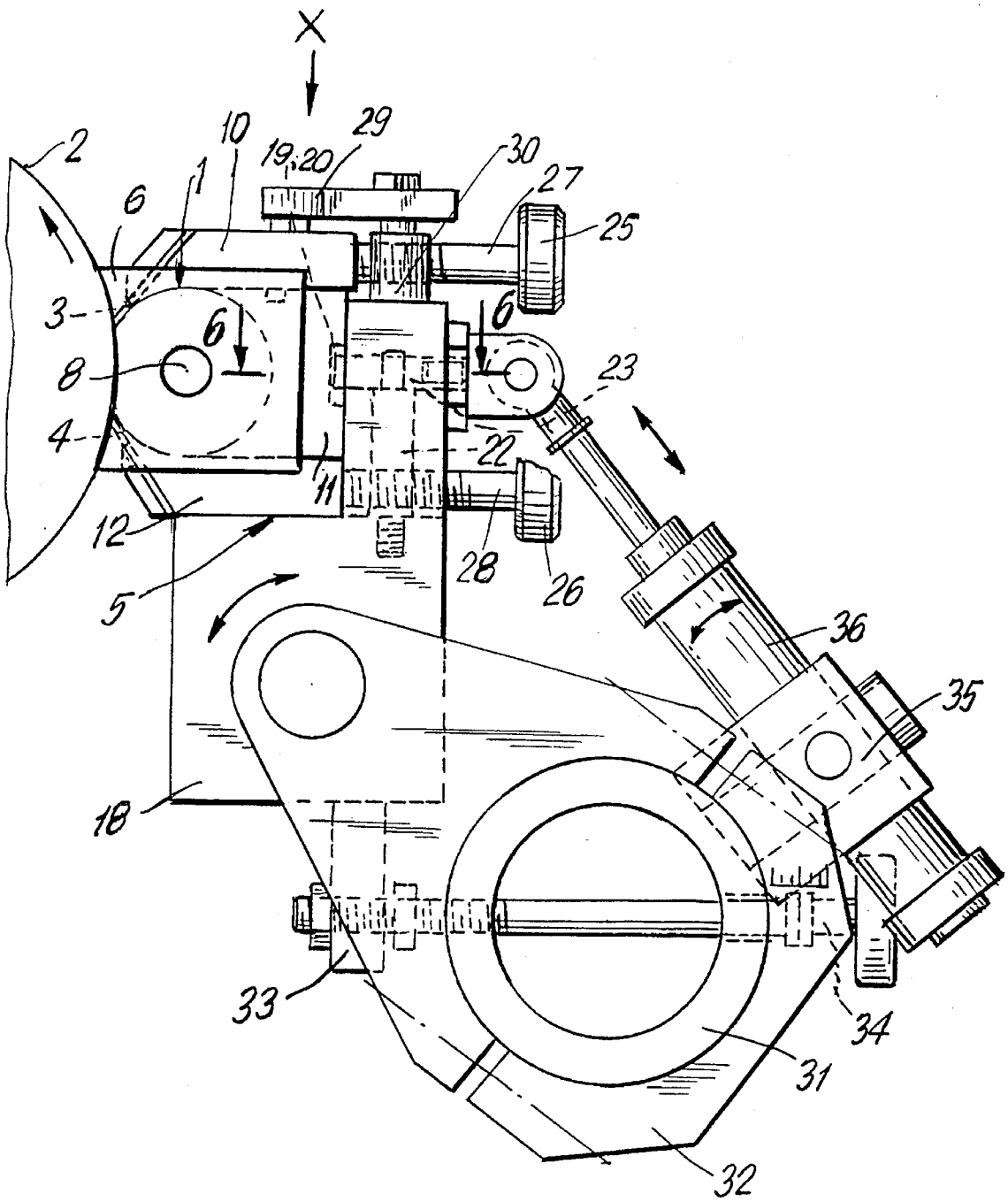
FIG. 5 is a side view of the inventive inking device.

FIG. 5 shows an example of a complete chamber blade using the inventive embodiment of FIG. 1. With the help of an arresting device shown in FIG. 6, the basic body 11 of the chamber body 5 is detachably connected to a blade carrier 18 so that a form piece 21, such as a back-gripping arresting body, rigidly connected to the blade carrier 18 and a lever 23 swingably attached to a standing pin 22 mounted in the blade carrier 18 engage respectively in a form-fitting manner in two inwardly widening recesses 19, 20 in the main body 11. The lever 23 is activated with a pressure actuated working cylinder 24 connected to the blade carrier 18.

For the purpose of being able to separately set the two blade knives, adjustment spindles 27, 28 grip on the working blade support 10 and the closing blade support 12, respectively. Each adjustment spindle 27, 28 is equipped with a handle 25, 26 having a position indicator for the setting path and is guided through the blade carrier 18. The spindles 27, 28 act in the direction of movement of the blade supports 10, 12.

Figure 7:
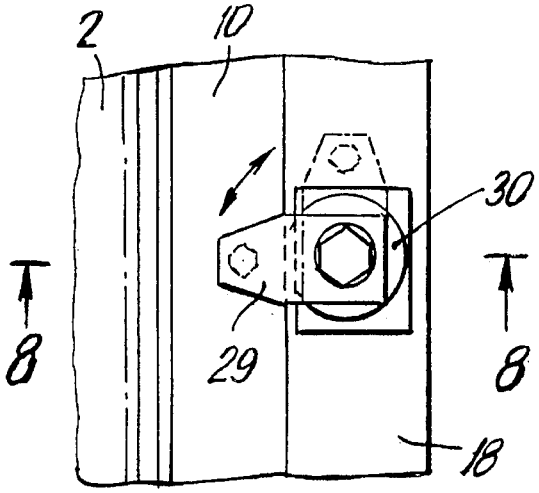
FIG. 7 is a view in the direction of arrow X in FIG. 5.
Figure 8:
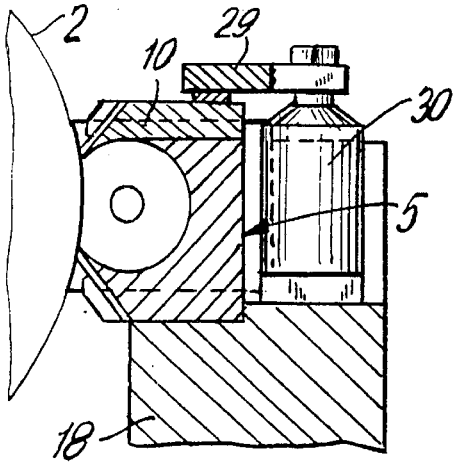
FIG. 8 is a section 8—8 of FIG. 7.

In order to prevent vibration during operation of the working blade 3, which is important for inking of the screen roller 2 and the blade carrier 18, at least one clamping lever 29 that is fixed on the working blade support 10 is swingably arranged in a manner that permits the working blade 3 to be changed. The clamping lever 29 is advantageously pivoted by a pressure actuated working cylinder 30 which carries out both a lifting movement and a swinging movement and is attached to the blade carrier 18 (FIG. 7, 8).

The blade carrier 18 (FIG. 5) is swingably or pivotally held on both sides by a holder 32 that is connected to the frame of the printing machine by a common pipe 31. For limiting the swinging movement of the blade carrier 18 toward the screen roller 2, an adjustment spindle 34 equipped with means for displaying the movement path position is conducted through the pipe 31. An adjustable stop 33 connected to the blade carrier 18 limits the travel of the spindle 34. Furthermore, a pressure operated working cylinder 36 is connected to the blade carrier 18 and pivots about a pivot bearing 35 to swing the blade carrier 18.

With the described device, the blade carrier 18 can be positioned on the screen roller in a multi-level fashion with low pressure while avoiding damage of the screen roller 2 and the blades.

FIG. 4 shows the side walls 6, 7, which lie in frontal fashion on the screen roller 2 or cover the blades and which seal off the ink chamber 1 and the chamber body 5. The side wall 7 is equipped with an ink outlet 37 lying axially across from the ink inlet 8 in the side wall 6, so that an ink flow attributable to a slight excess amount of ink compared to the ink consumed in the printing process occurs advantageously in the center of the ink roll rotating at minimal circumferential speed.

In addition, the surfaces of the blades, the chamber body 5 and the side walls 6, 7 which border the ink chamber 1 should be smooth to facilitate the flow of ink.

The embodiment shown in FIG. 1 can be used for both rotational directions of the screen roller 2, whereby the two blades 3, 4 exchange their respective functions as working blade and closing blade.

The invention is not exclusively bound to a working blade with a negative positioning angle, insofar as the creation of the ink roll according to the invention is also ensured with a positive positioning angle through a corresponding form of the ink chamber, for example, based on the area of the closing blade from FIG. 2.

Figure 9:
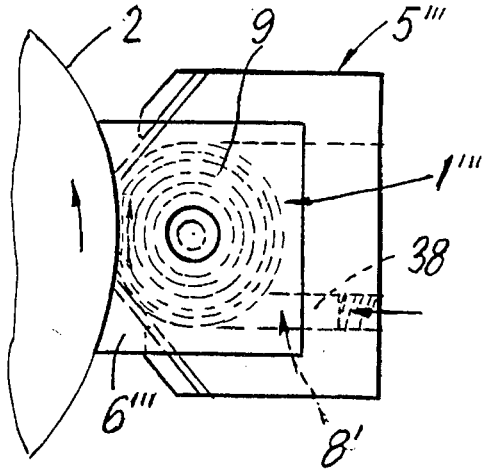
FIG. 9 is a view similar to FIG. 1 of a chamber blade with a tangential ink supply.

Compared to the ink inlet in FIG. 1, the ink inlet in FIG. 9 is modified in that the chamber body $5^{III}$ is equipped with at least one bore 38 which opens tangentially in the interior of the chamber body $5^{III}$. The bore 38 has threads on the outside of the chamber body to permit the connection of an ink conduit.

In addition, in a manner not shown, the bore 38 can be replaced by a longitudinal slot, which, as applicable, is connected for the purpose of improving the ink supply to a cross-sectionally widened longitudinal bore of the chamber body. The longitudinal bore is connected frontal to the chamber body $5^{III}$ directly or is longitudinally connected to the chamber body $5^{III}$ via one or more connection bores.

Figure 10:
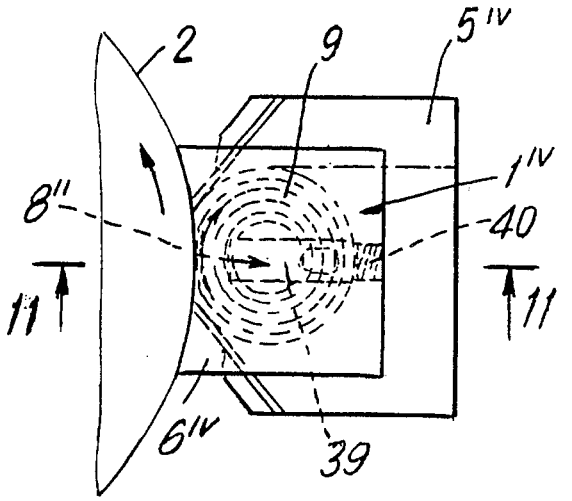
FIG. 10 is a view similar to FIG. 1 of a chamber blade with a frontal ink supply.
Figure 11:
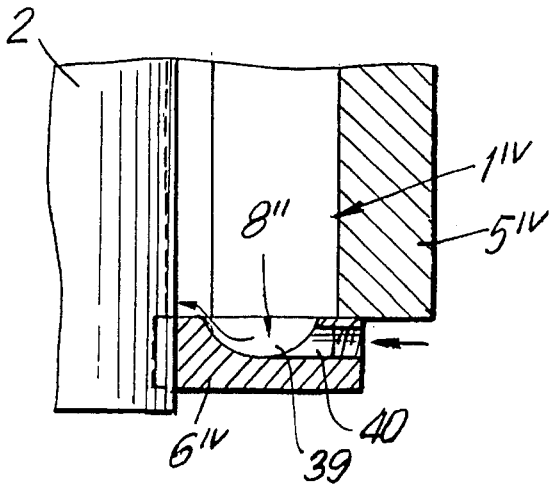
FIG. 11 is a section 11—11 of FIG. 10.

FIGS. 10 and 11 show a pocket-shaped recess 39 in a side wall $6^{IV}$, to which the ink is fed frontally to the ink roll 9 via a cross-bore 40. The passage of this recess 39 into the ink chamber $1^{IV}$ is designed to facilitate the flow of ink.

The invention is not limited by the embodiments described above which are presented as examples only but can be modified in various ways within the scope of protection defined by the appended patent claims.

We claim:

1. A device for inking a screen roller of a rotary printing machine, comprising:

a chamber body positionable against the screen roller and having a circular interior; sidewalls connected to the chamber body whereby the sidewalls and the chamber body interior define an ink chamber that is open toward the screen roller; at least one ink inlet provided so as to permit ink to flow to the ink chamber, the ink inlet being formed so as to permit creation of an ink roll that is rotated by rotation of the screen roller; a working blade arranged at a negative positioning angle relative to the rotational direction of the screen roller and being arrangable longitudinally adjacent the screen roller to border the ink chamber in the rotational direction of the screen roller; means for attaching the working blade to the chamber body so that the working blade is adjustable, the working attaching means including a working blade support mounted on the chamber body so as to be movable tangential to the circular interior of the chamber body, the working blade being mounted to the working blade support; a positionable blade carrier, the chamber body being attached to the blade carrier; stop means for positioning the blade carrier in a movable and multi-level fashion on the screen roller; and an adjustable spindle arranged to pass through the blade carrier and act in a direction of movement to engage and move the working blade support.

2. A device as defined in claim 1, wherein the ink inlet is arranged and adapted to feed ink into the ink chamber essentially axially.

3. A device as defined in claim 2, wherein the ink inlet is adapted to feed the ink to the ink chamber centrally to the ink roll.

4. A device as defined in claim 2, wherein the ink inlet is at least one bore in the chamber body that opens tangentially into the interior of the chamber body.

5. A device as defined in claim 1, wherein tile ink inlet is arranged and adapted to feed ink into the ink chamber essentially tangentially to the ink roll in a rotational direction of the ink roll.

6. A device as defined in claim 5, wherein the ink inlet is a longitudinal slot in the chamber body that opens tangentially into the interior of the chamber body.

7. A device as defined in claim 1, wherein tile ink inlet is arranged and adapted to feed ink into tile ink chamber frontally to the ink roll.

8. A device as defined in claim 7, wherein the ink inlet is provided in one of the sidewalls as a pocket-shaped recess that opens toward the ink chamber, and further comprising a cross bore provided in the one sidewall to connect with the pocket-shaped recess.

9. A device as defined in claim 7, wherein the chamber body has an ink outlet adapted to lead the ink from the ink chamber frontally, the ink outlet being provided on a side opposite the ink inlet.

10. A device as defined in claim 9, wherein the sidewalls are arranged to laterally cover the ink chamber and radially seal off the ink relative to the screen roller, each of the sidewalls having one of the ink outlet and the ink inlet therein.

11. A device as defined in claim 9, wherein the ink outlet and the ink inlet are provided as an axial bore in a respective one of the sidewalls.

12. A device as defined in claim 1, and further comprising means for feeding ink to the ink chamber as a function of ink overpressure in the ink chamber.

13. A device as defined in claim 1, wherein the circular interior of the chamber body defining the ink chamber has a smooth wall.

14. A device as defined in claim 1, wherein the circular interior of the chamber body has an ink-repellant wall.

15. A device as defined in claim 1, and further comprising at least one clamping lever pivotably connected to the blade carrier to permit a change of the working blade, and a pressure-operated working cylinder operatively connected to the clamping lever whereby the working blade support is fixed.

16. A device as defined in claim 1, wherein the chamber body is provided with recesses, and further comprising back-gripping arresting bodies arranged on the blade carrier to correspond with the recesses of the chamber body so that the arresting bodies are engagable in the recesses in a form-fitting manner, at least one of the arresting bodies being detachably mounted to its respective recess.

17. A device as defined in claim 16, wherein the detachable arresting body is a lever pivotably mounted to the blade carrier, and further comprising a working cylinder connected to the lever and pivotably connected to the blade carrier.

18. A device as defined in claim 1, and further comprising a frame, holders rigidly connected to the frame, the blade carrier being pivotably mounted to the holders, each holder including an adjustment spindle adapted to be operative in conjunction with the stop means, and still further comprising a working cylinder and a pivot bearing arranged to pivotally mount the working cylinder to the frame, the working cylinder being operatively connected to the blade carrier.

19. A device for inking a screen roller of a rotary printing machine, comprising: a chamber body positionable onto the screen roller and having a circular interior; sidewalls connected to the chamber body whereby the sidewalls and the chamber body interior define an ink chamber that is open toward the screen roller; at least one ink inlet provided so as to permit ink to flow to the ink chamber, the ink inlet being formed so as to permit creation of an ink roll that is rotated by rotation of the screen roller; a closing blade arranged at a positive positioning angle relative to the rotational direction of the screen roller and further being longitudinally adjacent the screen roller to border the ink chamber opposite to the rotational direction of the screen roller; means for attaching the closing blade to the chamber body so that the closing blade is adjustable, the closing blade attaching means including a closing blade support mounted to the chamber body so as to be movable tangential to the circular interior of the chamber body, the closing blade being mounted to the closing blade support; a positionable blade carrier, the chamber body being attached to the blade carrier; stop means for positioning the blade carrier in a movable and multi-level manner against the screen roller; and an adjustable spindle arranged to pass through the blade carrier and act in a direction of movement to engage and move the closing blade support.

20. A device as defining claim 19, wherein the ink inlet is arranged and adapted to feed ink into the ink chamber essentially axially.

21. A device as defined in claim 20, wherein the ink inlet is adapted to feed the ink to the ink chamber centrally to the ink roll.

22. A device as defined in claims 19, and further comprising means for feeding ink to the ink chamber as a function of ink overpressure in the ink chamber.

23. A device as defined in claim 19, wherein the circular interior of the chamber body defining the ink chamber as a smooth wall.

24. A device as defined in claim 19, wherein the circular interior of the chamber body has an ink-repellant wall.

* * * * *